US008851165B2

(12) United States Patent
Fielder et al.

(10) Patent No.: US 8,851,165 B2
(45) Date of Patent: Oct. 7, 2014

(54) COMPACT CABLE SUSPENDED PUMPING SYSTEM FOR LUBRICATOR DEPLOYMENT

(71) Applicant: Zeitecs B.V., Rijswijk (NL)

(72) Inventors: Lance I. Fielder, Sugar Land, TX (US); Matthew Crowley, Houston, TX (US); Holger Franz, Aachen (DE); Johannes Schmidt, Aachen (DE); Benjamin Eduard Wilkosz, Aachen (DE)

(73) Assignee: Zeitecs B.V., Rijswijk (NL)

( * ) Notice: Subject to any disclaimer, the term of this patent is extended or adjusted under 35 U.S.C. 154(b) by 0 days.

(21) Appl. No.: 13/959,942

(22) Filed: Aug. 6, 2013

(65) Prior Publication Data

US 2013/0315751 A1 Nov. 28, 2013

Related U.S. Application Data

(62) Division of application No. 12/794,547, filed on Jun. 4, 2010, now Pat. No. 8,534,366.

(51) Int. Cl.

| | |
|---|---|
| ***E21B 43/00*** | (2006.01) |
| ***E21B 33/072*** | (2006.01) |
| ***F04D 27/00*** | (2006.01) |
| ***E21B 33/076*** | (2006.01) |
| ***F04D 13/10*** | (2006.01) |
| ***F04B 47/02*** | (2006.01) |
| ***E21B 43/12*** | (2006.01) |
| ***E21B 19/00*** | (2006.01) |
| ***F04D 29/60*** | (2006.01) |

(52) U.S. Cl.

CPC ..... *F04D 27/00* (2013.01); *E21B 33/072* (2013.01); *E21B 33/076* (2013.01); *F04D 13/10* (2013.01); *F04B 47/02* (2013.01); *E21B 43/128* (2013.01); *E21B 19/002* (2013.01); *F04D 29/606* (2013.01)

USPC ..... 166/105; 417/44.1

(58) Field of Classification Search

USPC ..... 175/100, 101, 95, 102, 217, 232, 323, 175/324; 166/369, 105; 417/44.1, 423.1, 417/423.3

See application file for complete search history.

(56) References Cited

U.S. PATENT DOCUMENTS 2,866,594 A * 12/1958 Quick ..... 417/423.1
4,331,203 A 5/1982 Kiefer (Continued)

FOREIGN PATENT DOCUMENTS

GB 2 445 859 A 7/2008
GB 2445859 A * 7/2008 ..... E21B 43/12

(Continued)

OTHER PUBLICATIONS

Canadian Office Action for Canadian Patent Applicaton No. 2,799,958, dated May 12, 2014.

(Continued)

*Primary Examiner* — David Andrews
*Assistant Examiner* — Ronald Runyan
(74) *Attorney, Agent, or Firm* — Patterson & Sheridan, L.L.P.

(57) ABSTRACT

A pumping system includes a submersible high speed electric motor operable to rotate a drive shaft; a high speed pump rotationally connected to the drive shaft and including a rotor having one or more helicoidal vanes; an isolation device operable to expand into engagement with a production tubing string, thereby fluidly isolating an inlet of the pump from an outlet of the pump and rotationally connecting the motor and the pump to the casing string; a cable having two or less conductors and a strength sufficient to support the motor, the pump, the isolation device, and a power conversion module (PCM); and the PCM operable to receive a DC power signal from the cable, and supply a second power signal to the motor.

14 Claims, 12 Drawing Sheets

(56) References Cited

U.S. PATENT DOCUMENTS

| | | | | |
|---|---|---|---|---|
| 4,438,996 | A * | 3/1984 | Zehren | 439/137 |
| 4,940,095 | A * | 7/1990 | Newman | 166/378 |
| 5,041,749 | A * | 8/1991 | Gaser et al. | 310/156.22 |
| 5,207,273 | A * | 5/1993 | Cates et al. | 166/369 |
| 5,425,618 | A * | 6/1995 | Janigro et al. | 415/199.1 |
| 2009/0010783 | A1 * | 1/2009 | Appel et al. | 417/423.3 |
| 2010/0116506 | A1 | 5/2010 | Sbordone et al. | |

FOREIGN PATENT DOCUMENTS

| | | | |
|---|---|---|---|
| WO | 2008148613 | A2 | 12/2008 |
| WO | 2009077714 | A1 | 6/2009 |

OTHER PUBLICATIONS

Australian Patent Examination Report dated Feb. 13, 2014, for Australian Application No. 2011261686.

* cited by examiner

COMPACT CABLE SUSPENDED PUMPING SYSTEM FOR LUBRICATOR DEPLOYMENT

BACKGROUND OF THE INVENTION

1. Field of the Invention

Embodiments of the present invention generally relate to a compact cable suspended pumping system for lubricator deployment.

2. Description of the Related Art

The oil industry has utilized electric submersible pumps (ESPs) to produce high flow-rate wells for decades, the materials and design of these pumps has increased the ability of the system to survive for longer periods of time without intervention. These systems are typically deployed on the tubing string with the power cable fastened to the tubing by mechanical devices such as metal bands or metal cable protectors. Well intervention to replace the equipment requires the operator to pull the tubing string and power cable requiring a well servicing rig and special spooler to spool the cable safely. The industry has tried to find viable alternatives to this deployment method especially in offshore and remote locations where the cost increases significantly. There has been limited deployment of cable inserted in coil tubing where the coiled tubing is utilized to support the weight of the equipment and cable, although this system is seen as an improvement over jointed tubing the cost, reliability and availability of coiled tubing units have prohibited use on a broader basis.

Current intervention methods of deployment and retrieval of submersible pumps require well control by injecting heavy weight (a.k.a. kill) fluid in the wellbore to neutralize the flowing pressure thus reducing the chance of lose of well control. Typical electrical submersible pumping systems deployed in high flow rate wells require high horsepower to drive the pump which results in system lengths exceeding 200 feet in total length. The length of these systems does not allow for the units to be retrieved by a high pressure lubricator for land and offshore installations as such a lubricator would exceed the mast height of the well service rig.

SUMMARY OF THE INVENTION

Embodiments of the present invention generally relate to a compact cable suspended pumping system for lubricator deployment. In one embodiment, a method of installing or retrieving a pumping system into or from a live wellbore includes connecting a lubricator to a production tree of the live wellbore and raising or lowering one or more downhole components of the pumping system from or into the wellbore using the lubricator.

In another embodiment, a method of retrieving a pumping system from a live wellbore, includes engaging an upper seal of a lubricator with a deployment cable; connecting the lubricator to a production tree of the live wellbore; deploying a running tool into the tree using the deployment cable; engaging the running tool with a hanger of the pumping system; raising the running tool and pump hanger into the lubricator; engaging a lower seal of the lubricator with a pump cable of the pumping system; disengaging the upper seal from the deployment cable; raising the running tool and pump hanger out of the lubricator; engaging the upper seal with the pump cable; disengaging the lower seal from the pump cable; raising downhole components of the pumping system into the lubricator; closing a valve of the lubricator; disengaging the upper seal from the pump cable; and raising the downhole components out of the lubricator.

In another embodiment, a method of retrofitting a production tree for compatibility with a pumping system includes connecting a marine riser to a production tree of the wellbore; retrieving a first production tubing hanger from the tree through the riser; replacing the first tubing hanger with a second tubing hanger having an electrical interface disposed along an inner surface thereof; and installing an electric submersible pump assembly (ESP) into the tree and the wellbore. The pump hanger of the ESP engages the electrical interface. The method further includes operating the ESP by supplying electricity from the tree to a pump cable of the pumping system via the electrical interface.

In another embodiment, a pumping system, includes a submersible high speed electric motor operable to rotate a drive shaft; a high speed pump rotationally connected to the drive shaft and comprising a rotor having one or more helicoidal vanes; an isolation device operable to expand into engagement with a production tubing string, thereby fluidly isolating an inlet of the pump from an outlet of the pump and rotationally connecting the motor and the pump to the casing string; a cable having two or less conductors and a strength sufficient to support the motor, the pump, the isolation device, and a power conversion module (PCM); and the PCM operable to receive a DC power signal from the cable, and supply a second power signal to the motor.

In another embodiment, a submersible pump has one or more stages. Each stage includes a tubular housing; and a mandrel disposed in the housing. The mandrel includes a rotor rotatable relative to the housing. The rotor has an impeller portion, a shaft portion, and one or more helicoidal vanes extending along the impeller portion. The mandrel further includes a diffuser. The diffuser is connected to the housing, has the shaft portion extending therethrough, and has one or more vanes operable to negate swirl imparted to fluid pumped through the impeller portion. Each stage further includes a fluid passage. The fluid passage is formed between the housing and the mandrel and has a nozzle section, a throat section, and a diffuser section.

In another embodiment, a subsea production tree includes a head having a bore therethrough and a production passage formed through a wall thereof; a wellhead connector; and a production tubing hanger oriented within and fastened to the head. The production tubing hanger has an outer electrical interface providing electrical communication between the head and the tubing hanger, an inner electrical interface for providing electrical communication with a pump hanger of an electric submersible pump assembly, one or more leads extending between the interfaces, a bore therethrough, and a production passage formed through a wall thereof. The tubing hanger is oriented so that the tubing hanger production passage is aligned with the head production passage.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 3A illustrates deployment of a lubricator to the tree. FIG. 3B illustrates the lubricator landed on the tree and a running tool engaged with the pump hanger. FIG. 3C illustrates the pump hanger being retrieved from the tree. FIG. 3D illustrates the pump hanger exiting the lubricator and being retrieved to the vessel. FIG. 3E illustrates the downhole ESP components being retrieved from the tree. FIG. 3F illustrates the downhole ESP components exiting the lubricator and being retrieved to the vessel.

FIG. 4A illustrates deployment of a riser to the tree. FIG. 4B illustrates retrieval of the existing tubing hanger using a tubing hanger running tool.

DETAILED DESCRIPTION

Figure 1A:
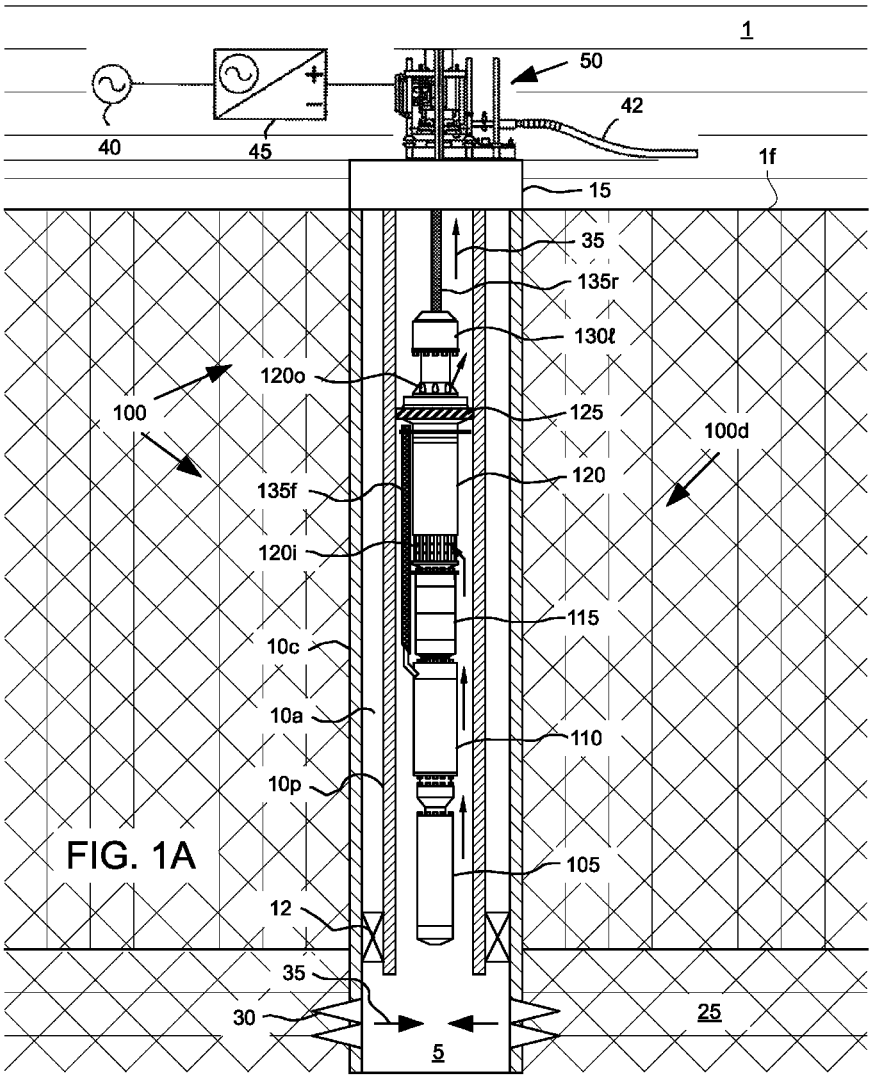
FIG. 1A illustrates an ESP system deployed in a subsea wellbore, according to one embodiment of the present invention.

FIG. 1A illustrates a pumping system, such as an ESP system 100, deployed in a subsea wellbore 5, according to one embodiment of the present invention. The wellbore 5 has been drilled from a floor if of the sea 1 into a hydrocarbon-bearing (i.e., crude oil and/or natural gas) reservoir 25. A string of casing 10*c* has been run into the wellbore 5 and set therein with cement (not shown). The casing 10*c* has been perforated 30 to provide to provide fluid communication between the reservoir 25 and a bore of the casing 10*c*. A wellhead 15 has been mounted on an end of the casing string 10*c*. A string of production tubing 10*p* may extend from the wellhead 15 to the formation 25 to transport production fluid 35 from the formation to the seafloor 1*f*. A packer 12 may be set between the production tubing 10*p* and the casing 10*c* to isolate an annulus 10*a* formed between the production tubing and the casing from production fluid 35.

A subsurface safety valve (SSV) (not shown) may be assembled as part of the production tubing string 10*p*. The SSV may include a housing, a valve member, a biasing member, and an actuator. The valve member may be a flapper operable between an open position and a closed position. The flapper may allow flow through the housing/production tubing bore in the open position and seal the housing/production tubing bore in the closed position. The flapper may operate as a check valve in the closed position i.e., preventing flow from the formation to the wellhead 5 but allowing flow from the wellhead to the formation. The actuator may be hydraulic or electric and include a flow tube for engaging the flapper and forcing the flapper to the open position. The flow tube may also be a piston in communication with a hydraulic conduit or electric cable (not shown) extending along an outer surface of the production tubing 10*p* to the wellhead 15. Injection of hydraulic fluid or application of electricity into the conduit/cable may move the flow tube against the biasing member (i.e., spring), thereby opening the flapper. The SSV may also include a spring biasing the flapper toward the closed position. Relief of hydraulic pressure/removal of current from the conduit/cable may allow the springs to close the flapper.

The Christmas or production tree 50 may be connected to the wellhead 15, such as by a collet, mandrel, or clamp tree connector. The tree 50 may be vertical or horizontal. If the tree 50 is vertical, it may be installed after the production tubing 10*p* is hung from the wellhead 15. If the tree 50 is horizontal, the tree may be installed and then the production tubing 10*p* may be hung from the tree 50. The tree 50 may include fittings and valves to control production from the wellbore into a pipeline 42 which may lead to a production facility (not shown), such as a production vessel or platform. The tree 50 may also be in fluid/electrical communication with the hydraulic conduit/cable controlling the SSV.

Figure 1B:
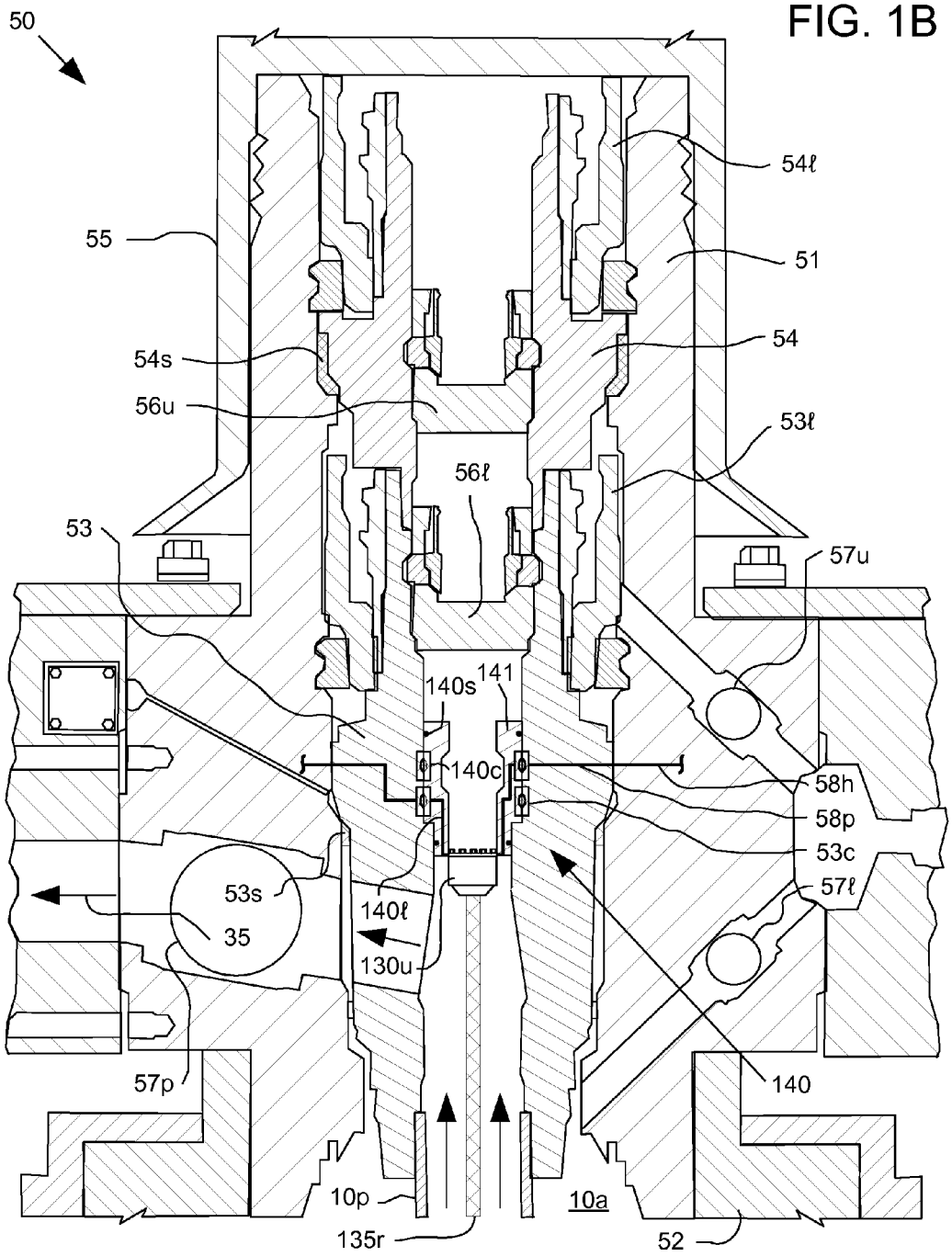
FIG. 1B illustrates the pump hanger hung from a tubing hanger of a horizontal tree.

The ESP system 100 may include an electric motor 105, a power conversion module (PCM) 110, a seal section 115, a pump 120, an isolation device 125, an upper cablehead 130*u*, a lower cablehead 130*l*, a power cable 135*r*, and a pump hanger 140 (see FIG. 1B). Housings of each of the components 105-130 may be longitudinally and rotationally connected, such as by flanged or threaded connections.

The tree 50 may include a controller 45 in electrical communication with an alternating current (AC) power source 40, such as transmission lines. Alternatively, the power source 40 may be direct current (DC). The tree controller 45 may include a transformer (not shown) for stepping the voltage of the AC power signal from the power source 40 to a medium voltage (V) signal. The medium voltage signal may be greater than one kV, such as five to ten kV. The tree controller may further include a rectifier for converting the medium voltage AC signal to a medium voltage direct current (DC) power signal for transmission downhole via power cable 135*r*. The tree controller 45 may further include a data modem (not shown) and a multiplexer (not shown) for modulating and multiplexing a data signal to/from the downhole controller with the DC power signal. The tree controller 45 may further include a transceiver (not shown) for data communication with a remote office (not shown).

The cable 135*r* may extend from the upper cable head 130*u* through the wellhead 15 and to the cable head 130. Each of the cable heads 130*u,l* may include a cable fastener (not shown), such as slips or a clamp for longitudinally connecting the cable 80*r*. Since the power signal may be DC, the cable 135*r* may only include two conductors arranged coaxially (discussed more below).

FIG. 1B illustrates the pump hanger 140 hung from a tubing hanger 53 of a horizontal tree 50. The tree 50 may include a head 51, a wellhead connector 52, the tubing hanger 53, an internal cap 54, an external cap 55, an upper crown plug 56*u*, a lower crown plug 56*l*, a production valve 57*p*, and one or more annulus valves 57*u,l*. Each of the components 51-54 may have a longitudinal bores extending therethrough. The tubing hanger 53 and head 51 may each have a lateral production passage formed through walls thereof for the flow of production fluid 35. The tubing hanger 53 may be disposed in the head bore. The tubing hanger 53 may support the production tubing 10*p*. The tubing hanger 53 may be fastened to the head by a latch 53*l*. The latch 53*l* may include one or more fasteners, such as dogs, an actuator, such as a cam sleeve. The cam sleeve may be operable to push the dogs outward into a profile formed in an inner surface of the tree head 51. The latch 53*l* may further include a collar for engagement with a running tool (not shown) for installing and removing the tubing hanger 53.

The tubing hanger 53 may be rotationally oriented and longitudinally aligned with the tree head 51. The tubing hanger 53 may further include seals 53*s* disposed above and below the production passage and engaging the tree head inner surface. The tubing hanger 53 may also have a number of auxiliary ports/conduits (not shown) spaced circumferentially there-around. Each port/conduit may align with a corresponding port/conduit (not shown) in the tree head for communicating hydraulic fluid or electricity for various purposes to tubing hanger 53, and from tubing hanger 53 downhole, such as operation of the SSV. The tubing hanger 53 may have an annular, partially spherical exterior portion that lands within a partially spherical surface formed in tree head 51.

The annulus 10*a* may communicate with an annulus passage formed through and along the head 51 for and bypassing the seals 53*s*. The annulus passage may be accessed by removing internal tree cap 54. The tree cap 54 may be disposed in head bore above tubing hanger 53. The tree cap 54 may have a downward depending isolation sleeve received by an upper end of tubing hanger 53. Similar to the tubing hanger 53, the tree cap 54 may include a latch 54*l* fastening the tree cap to the head 51. The tree cap 54 may further include a seal 54*s* engaging the head inner surface. The production valve 57*p* may be disposed in the production passage and the annulus valves 57*u,l* may be disposed in the annulus passage. Ports/conduits (not shown) may extend through the tree head 51 to the tree controller 45 for electrical or hydraulic operation of the valves.

The upper crown plug 56*u* may be disposed in tree cap bore and the lower crown plug 56*l* may be disposed in the tubing hanger bore. Each crown plug 56*u,l* may have a body with a metal seal on its lower end. The metal seal may be a depending lip that engages a tapered inner surface of the respective cap and hanger. The body may have a plurality of windows which allow fasteners, such as dogs, to extend and retract. The dogs may be pushed outward by an actuator, such as a central cam. The cam may have a profile on its upper end for engagement by a running tool 320 (discussed below). The cam may move between a lower locked position and an upper position freeing dogs to retract. A retainer may secure to the upper end of body to retain the cam.

The upper cable head 130*u* may be connected to the pump hanger 140, such as by fastening (i.e., threaded or flanged connection). The pump hanger 140 may include a tubular body 141 having a bore therethrough, one or more leads 140*l*, a part of one or more electrical couplings 140*c*, and one or more seals 140*s*. The pump hanger 140 may be connected to the tubing hanger 53 by resting on a shoulder formed in an inner surface of the tubing hanger. Alternatively or additionally, the pump hanger may be fastened to the tubing hanger by a latch.

Each lead 140*l* may be electrically connected to a respective one of the core 205 (see FIG. 2A) and the shield 215 via an electrical coupling (not shown). Each lead 140*l* may extend from the upper cable head 130*u* to a respective coupling part 140*c* and be electrically connected to the core/shield and the coupling part. Each coupling part 140*c* may include a contact, such as a ring, encased in insulation. The ring may be made from an electrically conductive material, such as aluminum, copper, aluminum alloy, copper alloy, or steel. The ring may also be split and biased outwardly. The insulation may be made from a dielectric material, such as a polymer (i.e., an elastomer or thermoplastic).

The tubing hanger 53 may include the other coupling parts 53*c* for receiving the respective pump hanger coupling parts 140*c*, thereby electrically connecting the pump hanger 140 and the tubing hanger 53. A lead 58*p* may be electrically connected to each tubing hanger coupling part 53*c* and extend through the tubing hanger 53 to a part of an electrical coupling (not shown) electrically connecting the tubing hanger lead with a tree head lead 58*h*. The tree head leads 58*h* may extend to the tree controller 45, thereby providing electrical communication between the controller and the cable 135*r*.

Figure 2A:
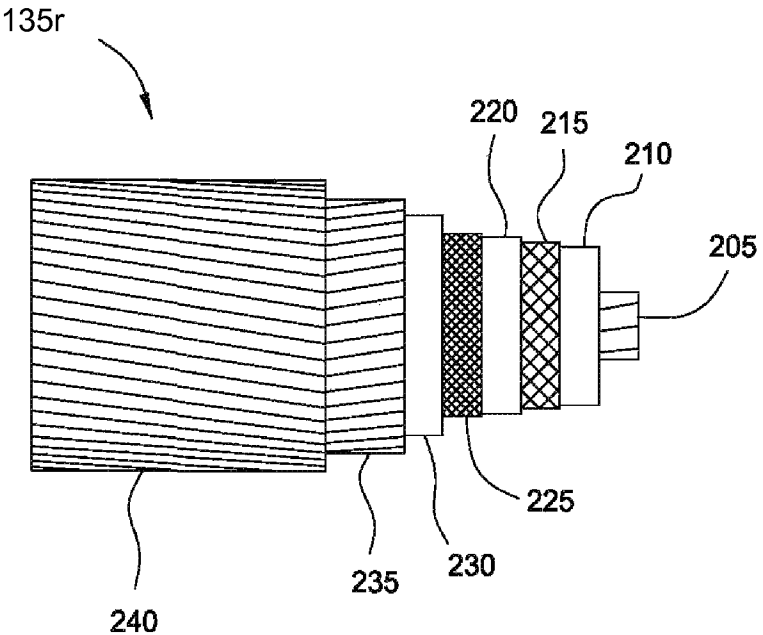
FIG. 2A is a layered view of the power cable.
Figure 2B:
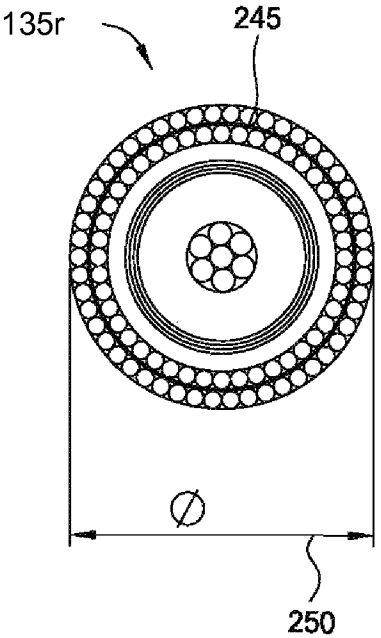
FIG. 2B is an end view of the power cable.

FIG. 2A is a layered view of the power cable 135*r*. FIG. 2B is an end view of the power cable 135*r*. The power cable 135*r* may include an inner core 205, an inner jacket 210, a shield 215, an outer jacket 230, and armor 235, 240.

The inner core 205 may be the first conductor and made from the electrically conductive material. The inner core 205 may be solid or stranded. The inner jacket 210 may electrically isolate the core 205 from the shield 215 and be made from the dielectric material. The shield 215 may serve as the second conductor and be made from the electrically conductive material. The shield 215 may be tubular, braided, or a foil covered by a braid. The outer jacket 230 may electrically isolate the shield 215 from the armor 235, 240 and be made from an oil-resistant dielectric material. The armor may be made from one or more layers 235, 240 of high strength material (i.e., tensile strength greater than or equal to one hundred, one fifty, or two hundred kpsi) to support the deployment weight (weight of the cable and the weight of the downhole components 100*d* (105-130)) so that the cable 135*r* may be used to deploy and remove the components 50-75 into/from the wellbore 5. The high strength material may be a metal or alloy and corrosion resistant, such as galvanized steel or a nickel alloy depending on the corrosiveness of the reservoir fluid 35. The armor may include two contra-helically wound layers 235, 240 of wire or strip.

Additionally, the cable 135*r* may include a sheath 225 disposed between the shield 215 and the outer jacket 230. The sheath 225 may be made from lubricative material, such as polytetrafluoroethylene (PTFE) or lead and may be tape helically wound around the shield 215. If lead is used for the sheath, a layer of bedding 220 may insulate the shield 215 from the sheath and be made from the dielectric material. Additionally, a buffer 245 may be disposed between the armor layers 235, 240. The buffer 245 may be tape and may be made from the lubricative material.

Due to the coaxial arrangement, the cable 135*r* may have an outer diameter 250 less than or equal to one and one-quarter inches, one inch, or three-quarters of an inch. Alternatively, the cable 135*r* may include three conductors and conduct three-phase AC power from the tree 50 to the motor 105.

Additionally, the cable 135*r* may further include a pressure containment layer (not shown) made from a material having sufficient strength to contain radial thermal expansion of the dielectric layers and wound to allow longitudinal expansion thereof. The material may be stainless steel and may be strip or wire. Alternatively, the cable 135*r* may include only one conductor and the production tubing 10*p* may be used for the other conductor.

The cable 135*r* may be longitudinally coupled to the lower cablehead 130*l* by a shearable connection (not shown). The cable 135*r* may be sufficiently strong so that a margin exists between the deployment weight and the strength of the cable. For example, if the deployment weight is ten thousand pounds, the shearable connection may be set to fail at fifteen thousand pounds and the cable may be rated to twenty thousand pounds. The lower cablehead 130*l* may further include a fishneck so that if the downhole components 100*d* become trapped in the wellbore, such as by jamming of the isolation device 125 or buildup of sand, the cable 135*r* may be freed from rest of the components by operating the shearable connection and a fishing tool (not shown), such as an overshot, may be deployed to retrieve the components 100*d*.

The lower cablehead 130*l* may also include leads (not shown) extending therethrough, through the outlet 120*o*, and through the isolation device 125. The leads may provide electrical communication between the conductors of the cable 135*r* and conductors of a flat cable 135*f*. The flat cable 135*f* may extend along the pump 120, the intake 120*i*, and the seal section 115 to the PCM 110. The flat cable 135*f* may have a low profile to account for limited annular clearance between the components 115, 120 and the production tubing 10*p*. Since the flat cable 135*f* may conduct the DC signal, the flat cable may only require two conductors (not shown) and may only need to support its own weight. The flat cable 135*f* may be armored by a metal or alloy.

The motor 105 may be switched reluctance motor (SRM) or permanent magnet motor, such as a brushless DC motor (BLDC). The motor 105 may be filled with a dielectric, thermally conductive liquid lubricant, such as oil. The motor 105 may be cooled by thermal communication with the production fluid 35. The motor 105 may include a thrust bearing (not shown) for supporting a drive shaft (not shown). In operation, the motor may rotate the shaft, thereby driving the pump 120. The motor shaft may be directly connected to the pump shaft (no gearbox).

The SRM motor may include a multi-lobed rotor made from a magnetic material and a multi-lobed stator. Each lobe of the stator may be wound and opposing lobes may be connected in series to define each phase. For example, the SRM motor may be three-phase (six stator lobes) and include a four-lobed rotor. The BLDC motor may be two pole and three phase. The BLDC motor may include the stator having the three phase winding, a permanent magnet rotor, and a rotor position sensor. The permanent magnet rotor may be made of one or more rare earth, ceramic, or cermet magnets. The rotor position sensor may be a Hall-effect sensor, a rotary encoder, or sensorless (i.e., measurement of back EMF in undriven coils by the motor controller).

The PCM 110 may include a motor controller (not shown), a modem (not shown), and demultiplexer (not shown). The modem and demultiplexer may demultiplex a data signal from the DC power signal, demodulate the signal, and transmit the data signal to the motor controller. The motor controller may receive the medium voltage DC signal from the cable and sequentially switch phases of the motor, thereby supplying an output signal to drive the phases of the motor. The output signal may be stepped, trapezoidal, or sinusoidal. The BLDC motor controller may be in communication with the rotor position sensor and include a bank of transistors or thyristors and a chopper drive for complex control (i.e., variable speed drive and/or soft start capability). The SRM motor controller may include a logic circuit for simple control (i.e. predetermined speed) or a microprocessor for complex control (i.e., variable speed drive and/or soft start capability). The SRM motor controller may use one or two-phase excitation, be unipolar or bi-polar, and control the speed of the motor by controlling the switching frequency. The SRM motor controller may include an asymmetric bridge or half-bridge.

Additionally, the PCM 110 may include a power supply (not shown). The power supply may include one or more DC/DC converters, each converter including an inverter, a transformer, and a rectifier for converting the DC power signal into an AC power signal and stepping the voltage from medium to low, such as less than or equal to one kV. The power supply may include multiple DC/DC converters in series to gradually step the DC voltage from medium to low. The low voltage DC signal may then be supplied to the motor controller.

A suitable motor and PCM is discussed and illustrated in PCT Publication WO 2008/148613, which is herein incorporated by reference in its entirety.

The motor controller may be in data communication with one or more sensors (not shown) distributed throughout the downhole components 100*d*. A pressure and temperature (PT) sensor may be in fluid communication with the reservoir fluid 35 entering the intake 120*i*. A gas to oil ratio (GOR) sensor may be in fluid communication with the reservoir fluid entering the intake 120*i*. A second PT sensor may be in fluid communication with the reservoir fluid discharged from the outlet 120*o*. A temperature sensor (or PT sensor) may be in fluid communication with the lubricant to ensure that the motor 105 and downhole controller are being sufficiently cooled. Multiple temperature sensors may be included in the PCM 110 for monitoring and recording temperatures of the various electronic components. A voltage meter and current (VAMP) sensor may be in electrical communication with the cable 135*r* to monitor power loss from the cable. A second VAMP sensor may be in electrical communication with the power supply output to monitor performance of the power supply. Further, one or more vibration sensors may monitor operation of the motor 105, the pump 120, and/or the seal section 115. A flow meter may be in fluid communication with the outlet 120*o* for monitoring a flow rate of the pump 120. Utilizing data from the sensors, the motor controller may monitor for adverse conditions, such as pump-off, gas lock, or abnormal power performance and take remedial action before damage to the pump 120 and/or motor 105 occurs.

The seal section 115 may isolate the reservoir fluid 35 being pumped through the pump 120 from the lubricant in the motor 105 by equalizing the lubricant pressure with the pressure of the reservoir fluid 35. The seal section 115 may rotationally couple the motor shaft to a drive shaft of the pump. The shaft seal may house a thrust bearing capable of supporting thrust load from the pump 120. The seal section 115 may be positive type or labyrinth type. The positive type may include an elastic, fluid-barrier bag to allow for thermal expansion of the motor lubricant during operation. The labyrinth type may include tube paths extending between a lubricant chamber and a reservoir fluid chamber providing limited fluid communication between the chambers.

The pump 120 may have an inlet 120*i*. The inlet 120*i* may be standard type, static gas separator type, or rotary gas separator type depending on the GOR of the production fluid 35. The standard type intake may include a plurality of ports allowing reservoir fluid 35 to enter a lower or first stage of the pump 120. The standard intake may include a screen to filter particulates from the reservoir fluid 35. The static gas separator type may include a reverse-flow path to separate a gas portion of the reservoir fluid 35 from a liquid portion of the reservoir fluid 35.

The isolation device 125 may include a packer, an anchor, and an actuator. The actuator may include a brake, a cam, and a cam follower. The packer may be made from a polymer, such as a thermoplastic or elastomer, such as rubber, polyurethane, or PTFE. The cam may have a profile, such as a J-slot and the cam follower may include a pin engaged with the J-slot. The anchor may include one or more sets of slips, and one or more respective cones. The slips may engage the production tubing 10*p*, thereby rotationally connecting the downhole components 100*d* to the production tubing. The slips may also longitudinally support the downhole components 100*d*. The brake and the cam follower may be longitudinally connected and may also be rotationally connected. The brake may engage the production tubing as the downhole components 100*d* are being run-into the wellbore. The brake may include bow springs for engaging the production tubing. Once the downhole components 100*d* have reached deployment depth, the cable 135*r* may be raised, thereby causing the cam follower to shift from a run-in position to a deployment position. The cable may then be relaxed, thereby, causing the weight of the downhole components 100*d* to compress the packer and the slips and the respective cones, thereby engaging the packer and the slips with the production tubing. The isolation device 125 may then be released by pulling on the cable 135*r*, thereby again shifting the cam follower to a release position. Continued pulling on the cable 135*r* may release the packer and the slips, thereby freeing the downhole components 100*d* from the production tubing 10*p*.

Alternatively, the actuator may include a piston and a control valve. Once the downhole components 100*d* have reached deployment depth, the motor and pump may be activated. The control valve may remain closed until the pump exerts a predetermined pressure on the valve. The predetermined pressure may cause the piston to compress the packer and the slips and cones, thereby engaging the packer and the slips with the production tubing. The valve may further include a vent to release pressure from the piston once pumping has ceased, thereby freeing the slips and the packer from the production tubing. Additionally, the actuator may further be configured so that relaxation of the cable 135*r* also exerts weight to further compress the packer, slips, and cones and release of the slips may further include exerting tension on the cable 135*r*.

Additionally, the isolation device 125 may include a bypass vent (not shown) for releasing gas separated by the inlet 120*i* that may collect below the isolation device and preventing gas lock of the pump 120. A pressure relief valve (not shown) may be disposed in the bypass vent. Additionally, a downhole tractor (not shown) may be integrated into the cable to facilitate the delivery of the pumping system, especially for highly deviated wells, such as those having an inclination of more than 45 degrees or dogleg severity in excess of five degrees per one hundred feet. The drive and wheels of the tractor may be collapsed against the cable and deployed when required by a signal from the surface.

Figures 1C, 1D:
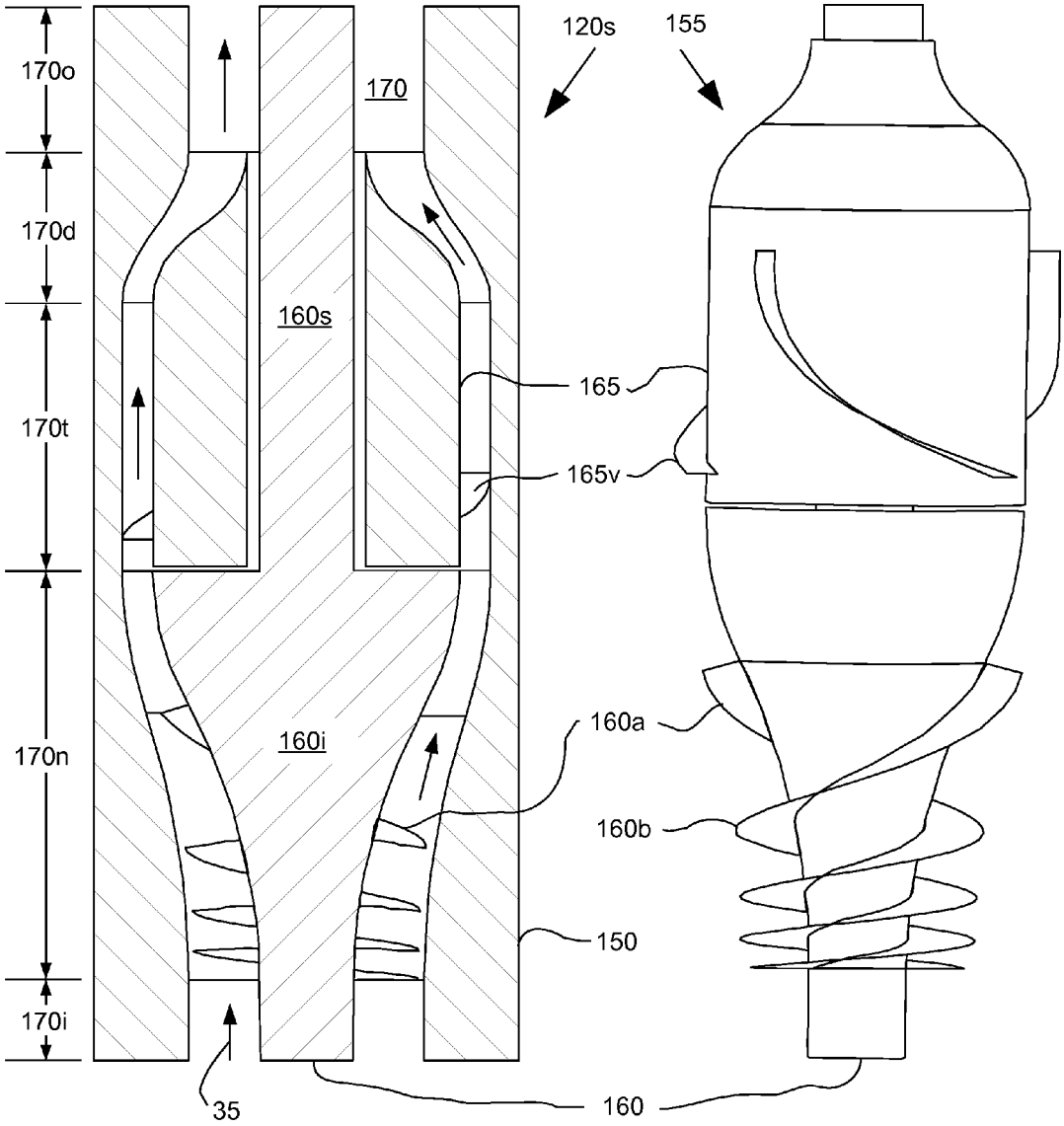
FIG. 1C is a cross-section of a stage of the pump.
FIG. 1D is an external view of a mandrel of the pump stage.

FIG. 1C is a cross-section of a stage 120*s* of the pump 120. FIG. 1D is an external view of a mandrel 155 of the pump stage 120*s*. The pump 120 may include one or more stages 120*s*, such as three. Each stage 120*s* may be longitudinally and rotationally connected, such as with threaded couplings or flanges (not shown). Each stage 120*s* may include a housing 150, a mandrel 155, and an annular passage 170 formed between the housing and the mandrel. The housing 150 may be tubular and have a bore therethrough. The mandrel 155 may be disposed in the housing 150. The mandrel 155 may include a rotor 160, one or more helicoidal rotor vanes 160*a, b*, a diffuser 165, and one or more diffuser vanes 165*v*. The rotor 160, housing 150, and diffuser 165 may each be made from a metal, alloy, or cermet corrosion and erosion resistant to the production fluid, such as steel, stainless steel, or a specialty alloy, such as chrome-nickel-molybdenum. Alternatively, the rotor, housing, and diffuser may be surface-hardened or coated to resist erosion.

The rotor 160 may include a shaft portion 160*s* and an impeller portion 160*i*. The portions 160*i,s* may be integrally formed. Alternatively, the portions 160*i,s* may be separately formed and longitudinally and rotationally connected, such as by a threaded connection. The rotor 160 may be supported from the diffuser 165 for rotation relative to the diffuser and the housing 150 by a hydrodynamic radial bearing (not shown) formed between an inner surface of the diffuser and an outer surface of the shaft portion 160*s*. The radial bearing may utilize production fluid or may be isolated from the production fluid by one or more dynamic seals, such as mechanical seals, controlled gap seals, or labyrinth seals. The diffuser 165 may be solid or hollow. If the diffuser is hollow, it may serve as a lubricant reservoir in fluid communication with the hydrodynamic bearing. Alternatively, one or more rolling element bearings, such as a ball bearings, may be disposed between the diffuser 165 and shaft portion 160*s* instead of the hydrodynamic bearings.

The rotor vanes 160*a,b* may be formed with the rotor 160 and extend from an outer surface thereof or be disposed along and around an outer surface thereof. Alternatively the rotor vanes 160*a,b* may be deposited on an outer surface of the rotor after the rotor is formed, such as by spraying or weld-forming. The rotor vanes 160*a,b* may interweave to form a pumping cavity therebetween. A pitch of the pumping cavity may increase from an inlet 170*i* of the stage 120*s* to an outlet 170*o* of the stage. The rotor 160 may be longitudinally and rotationally coupled to the motor drive shaft and be rotated by operation of the motor. As the rotor is rotated, the production fluid 35 may be pumped along the cavity from the inlet 170*i* toward the outlet 170*o*.

An outer diameter of the impeller 160*i* may increase from the inlet 170*i* toward the outlet 170*o* in a curved fashion until the impeller outer diameter corresponds to an outer diameter of the diffuser 165. An inner diameter of the housing 150 facing the impeller portion 160*i* may increase from the inlet 170*i* to the outlet 170*o* and the housing inner surface may converge toward the impeller outer surface, thereby decreasing an area of the passage 170 and forming a nozzle 170*n*. As the production fluid 35 is forced through the nozzle 170*n* by the rotor vanes 160*a,b*, a velocity of the production fluid 35 may be increased.

The stator may include the housing 150 and the diffuser 165. The diffuser 165 may be formed integrally with or separately from the housing 150. The diffuser 165 may be tubular and have a bore therethrough. The rotor 160 may have a shoulder between the impeller 160*i* and shaft 160*s* portions facing an end of the diffuser 165. The shaft portion 160*s* may extend through the diffuser 165. The diffuser 165 may be longitudinally and rotationally connected to the housing 150 by one or more ribs. An outer diameter of the diffuser 165 and an inner diameter of the housing 150 may remain constant, thereby forming a throat 170*t* of the passage 170. The diffuser vanes 165*v* may be formed with the diffuser 165 and extend from an outer surface thereof or be disposed along and around an outer surface thereof. Alternatively the diffuser vanes 165*v* may be deposited on an outer surface of the diffuser after the diffuser is formed, such as by spraying or weld-forming. Each diffuser vane 165*v* may extend along an outer surface of the diffuser 165 and curve around a substantial portion of the circumference thereof. Cumulatively, the diffuser vanes 165*v* may extend around the entire circumference of the diffuser 165. The diffuser vanes 165*v* may be oriented to negate swirl in the flow of production fluid 35 caused by the rotor vanes 160*a,b*, thereby minimizing energy loss due to turbulent flow of the production fluid 35. In other words, the diffuser vanes 165*v* may serve as a vortex breaker. Alternatively, a single helical diffuser vane may be used instead of a plurality of diffuser vanes 165*v*.

An outer diameter of the diffuser 165 may decrease away from the inlet 170*i* to the outlet 170*o* in a curved fashion until an end of the diffuser 165 is reached and an outer surface of the shaft portion 160*s* is exposed to the passage 170. An inner diameter of the housing 150 facing the diffuser 165 may decrease away from the inlet 170*i* to the outlet 170*o* and the housing inner surface may diverge from the diffuser outer surface, thereby increasing an area of the passage 170 and forming a diffuser 170*d*. As the production fluid 35 flows through the diffuser 170*d*, a velocity of the production fluid 35 may be decreased. Inclusion of the Venturi 170*n,t,d* may also minimize fluid energy loss in the production fluid discharged from the rotor vanes 160*a,b*.

In order to be compatible with a lubricator 305 (discussed below), the motor 105 and pump 120 may operate at high speed so that the compact pump 120 may generate the necessary head to pump the production fluid 35 to the tree 50 while keeping a length of the downhole components 100*d* less than or equal to a length of the lubricator 305. High speed may be greater than or equal to ten thousand, fifteen thousand, or twenty thousand revolutions per minute (RPM). For example, for a lubricator having a tool housing length of sixty feet, a length of the downhole components 100*d* may be fifty feet and a maximum outer diameter of the downhole components may be five point six two inches.

Figure 3A:
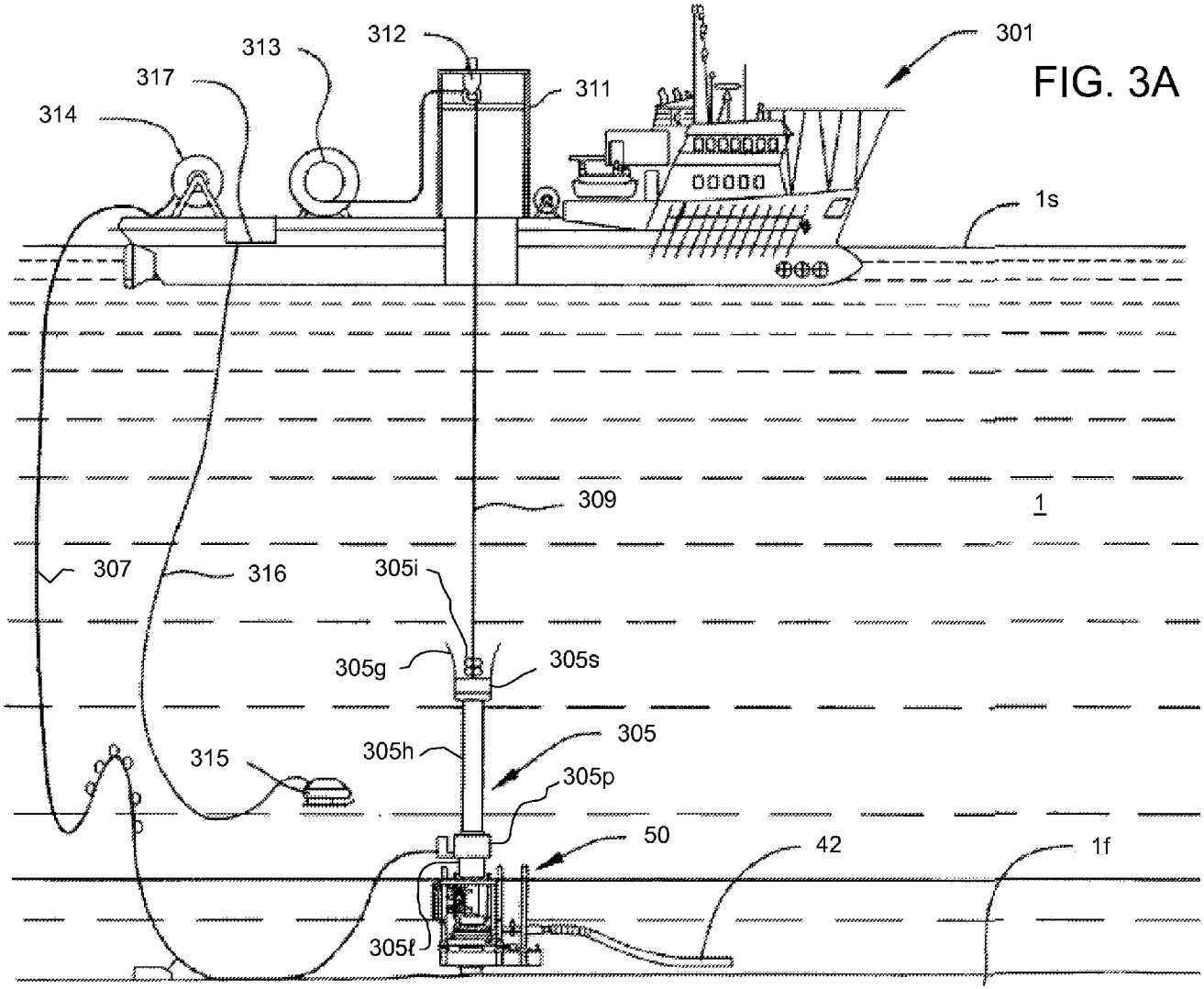
FIGS. 3A-3F illustrate retrieving the ESP riserlessly, according to another embodiment of the present invention.
Figure 3B:
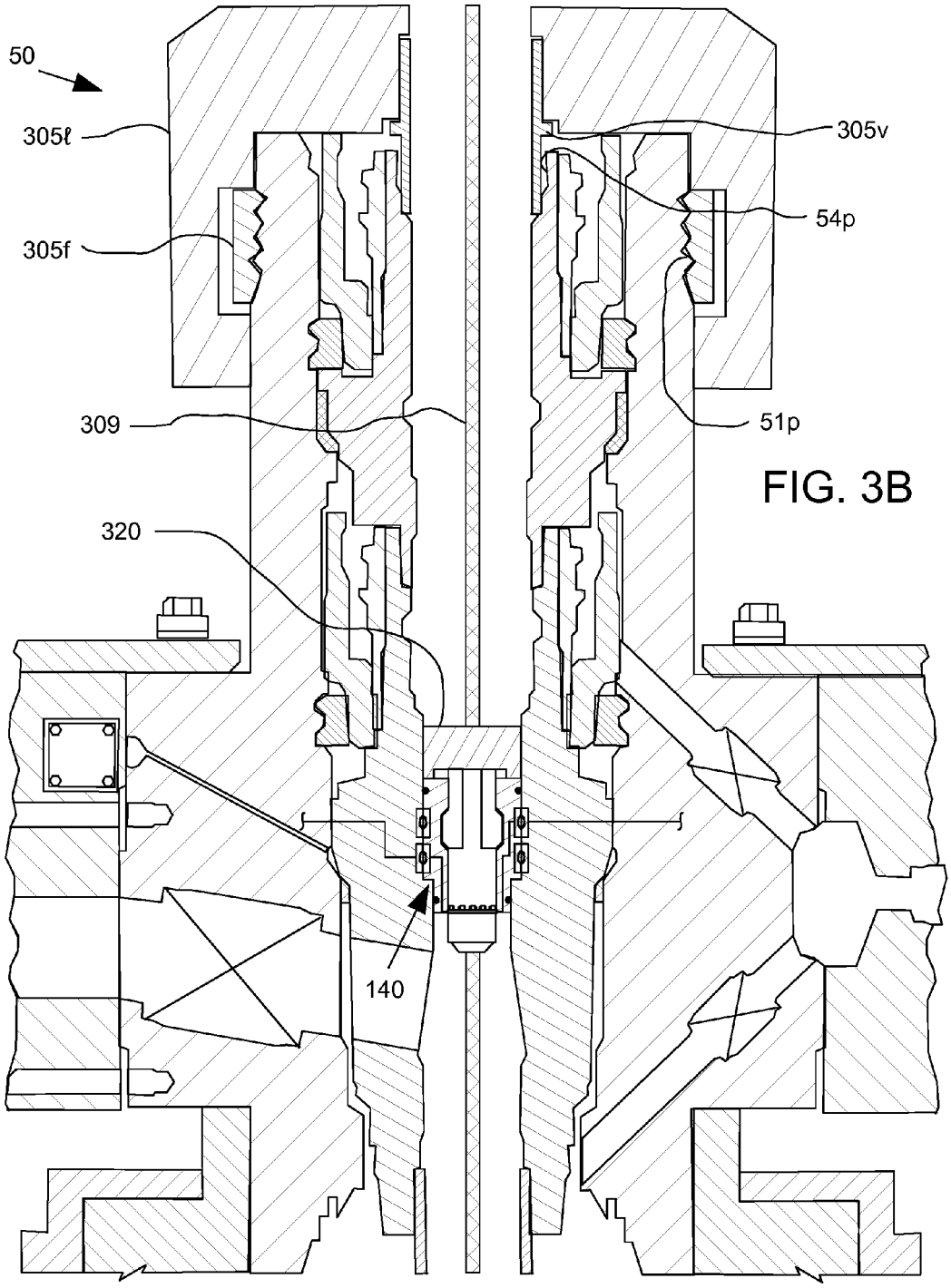
Figure 3C:
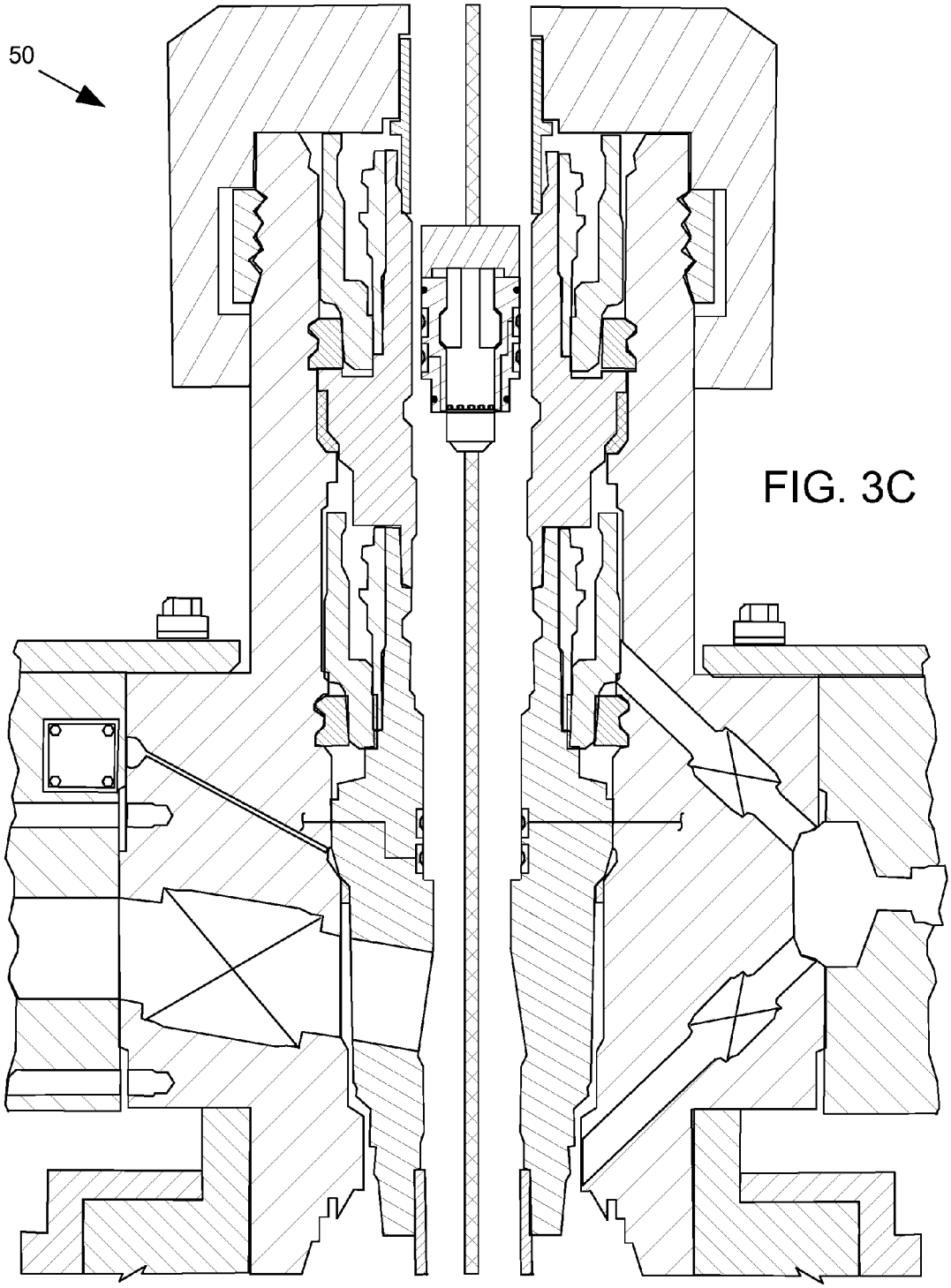
Figure 3D:
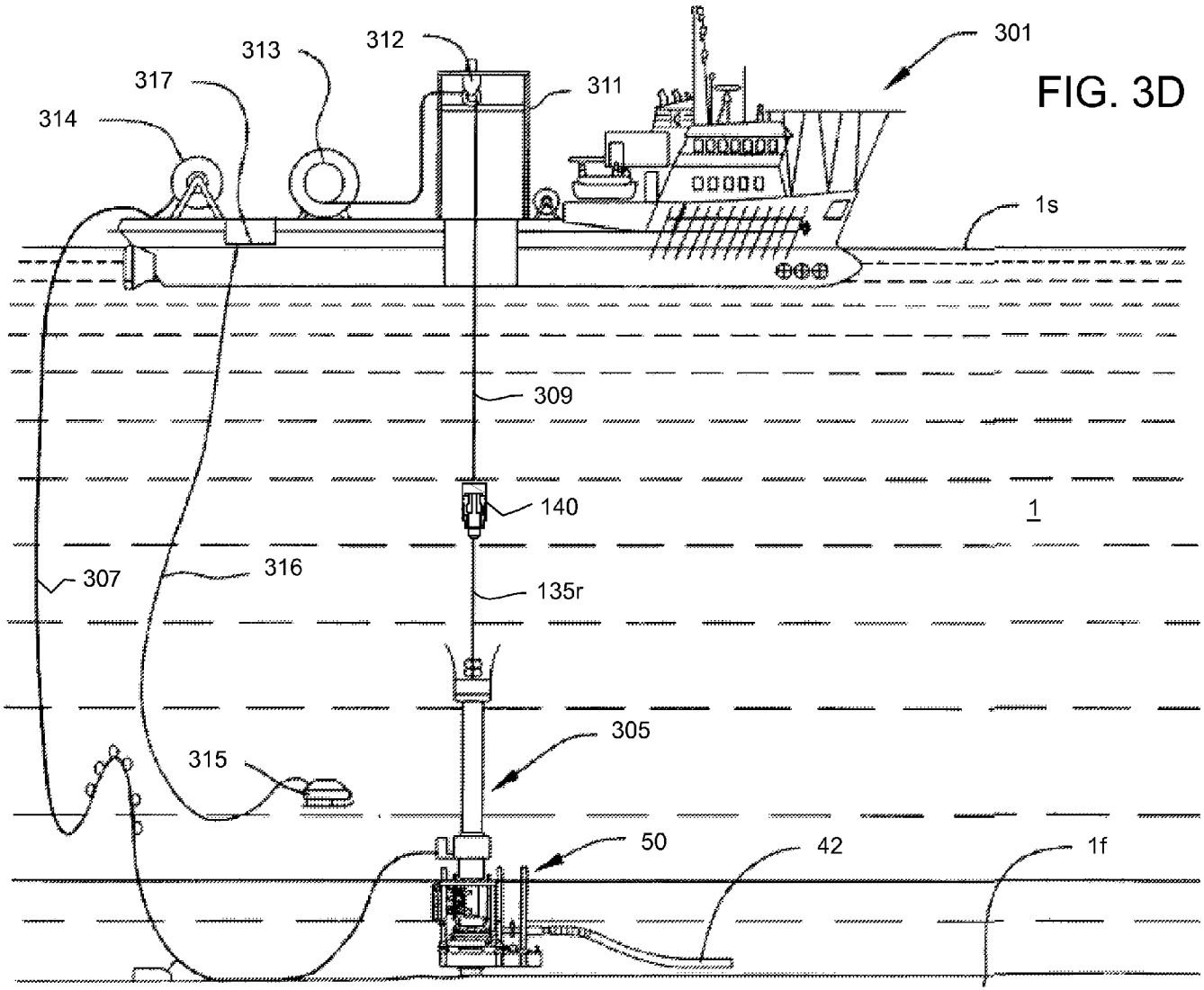
Figure 3E:
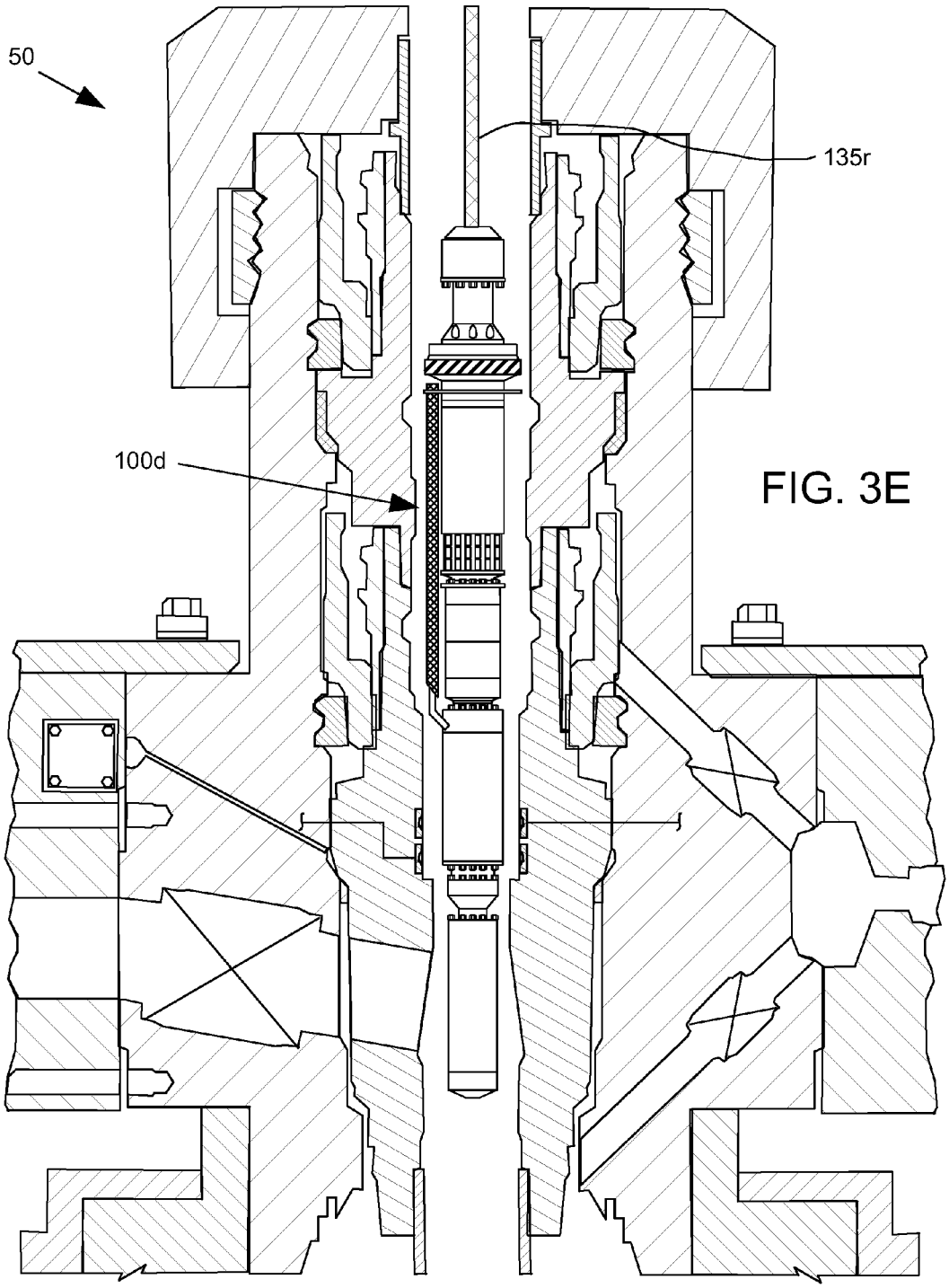
Figure 3F:
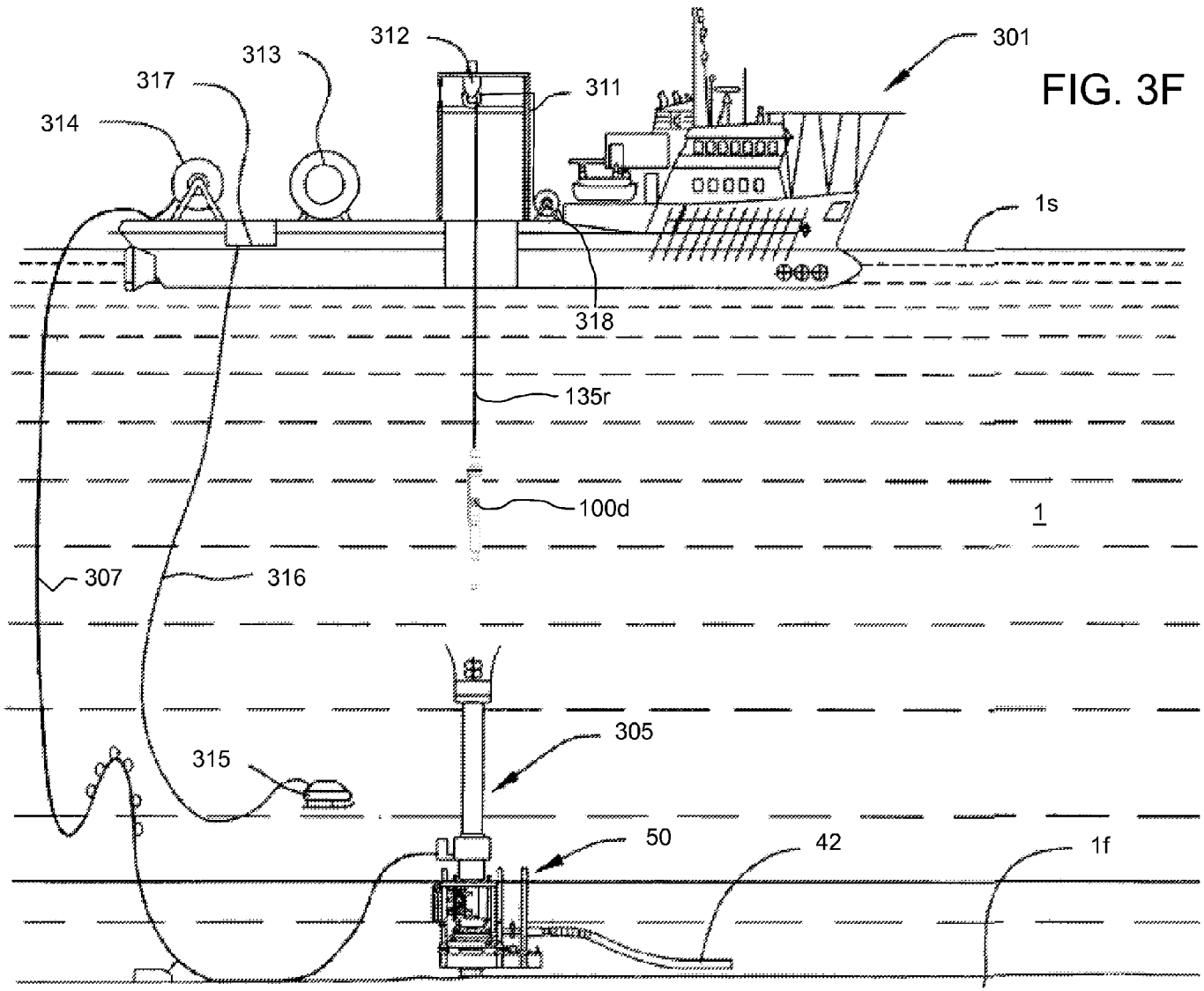

FIGS. 3A-3F illustrate retrieving the ESP 100 riserlessly, according to another embodiment of the present invention. FIG. 3A illustrates deployment of a lubricator 305 to the tree 50. FIG. 3B illustrates the lubricator 305 landed on the tree 50 and a running tool 320 engaged with the pump hanger 140. FIG. 3C illustrates the pump hanger 140 being retrieved from the tree 50. FIG. 3D illustrates the pump hanger 140 exiting the lubricator 305 and being retrieved to the vessel 301. FIG. 3E illustrates the downhole ESP components 100*d* being retrieved from the tree 50. FIG. 3F illustrates the downhole ESP components 100*d* exiting the lubricator 305 and being retrieved to the vessel 301.

A support vessel 301 may be deployed to a location of the subsea tree 50. The support vessel 301 may include a dynamic positioning system to maintain position of the vessel 301 on the surface 1*s* over the tree 50 and a heave compensator to account for vessel heave due to wave action of the sea 1. The vessel 301 may further include a tower 311 having an injector 312 for deployment cable 309. The deployment cable 309 may be similar or identical to the pump cable 135*r*, discussed above. The injector 312 may wind or unwind the deployment cable 309 from drum 313. Alternatively, the electrical conductors may be omitted from the deployment cable 309. Alternatively, coiled tubing or coiled rod may be used instead of the deployment cable and may have the same outer diameter as the deployment cable.

A remotely operated vehicle (ROV) 315 may be deployed into the sea 1 from the support vessel 301. The ROV 315 may be an unmanned, self-propelled submarine that includes a video camera, an articulating arm, a thruster, and other instruments for performing a variety of tasks. The ROV 315 may further include a chassis made from a light metal or alloy, such as aluminum, and a float made from a buoyant material, such as syntactic foam, located at a top of the chassis. The ROV 315 may be controlled and supplied with power from support vessel 301. The ROV 315 may be connected to support vessel 1 by a tether 316. The tether 316 may provide electrical, hydraulic, and/or data communication between the ROV 315 and the support vessel 301. An operator on the support vessel 301 may control the movement and operations of ROV 315. The tether may be wound or unwound from drum 317.

The ROV 315 may be deployed to the tree 50. The ROV 315 may transmit video to the operator on the vessel 301 for inspection of the tree 50. The ROV 315 may then interface with the tree 50, such as via a hot stab, and close the valves 57*u,l,p*. The ROV 315 may remove the external cap 55 from the tree 50 and carry the cap to the vessel 301. Alternatively, a hoist on the vessel 301, such as a crane or winch, may be used to transport the external cap 55 to the surface 1*s*. The ROV 315 may then inspect an internal profile of the tree 50. The injector 312, deployment line 309, and running tool 320 may be used to lower the lubricator 305 to the tree 50 through the moonpool of the vessel 1. Alternatively, the lubricator 305 may be lowered by the vessel hoist and then the deployment line 309 and running tool 320 may be inserted into the lubricator. The ROV 315 may guide landing of the lubricator 305 on the tree 50. The ROV 315 may then operate fasteners 305*f* of the lander 305*l*, to connect the lander with the tree 50. The ROV 315 may then deploy an umbilical 307 from the vessel 301 and connect the umbilical to the lubricator 305.

The lubricator 305 may include a lander 305*l*, a pressure control assembly 305*p*, a tool housing 305*h*, a seal head 305*s*, and a guide 305*g*. The lander 305*l* may include fasteners 305*f*, such as dogs, for fastening the lubricator 305 to an external profile 51*p* of the tree 50 and a seal sleeve 305*v* for engaging an internal profile 54*p* of the tree. The lander 305*l* may further include an actuator operable by the ROV for engaging the dogs with the external profile. The pressure control assembly 305*p* may include one or more blow out preventers (BOPs), a shutoff valve operable from the vessel 301 via the umbilical 307, and one or more grease injectors or stuffing boxes, such as two. The BOPs may include one or more ram assemblies, such as two. The BOPs may include a pair of blind rams capable of cutting the cables when actuated and sealing the bore, and a pair of cable rams for sealing against an outer surface of the cables 135*r*, 309 when actuated.

The tool housing 305*h* may be of sufficient length to contain the downhole ESP components 100*d* so that the seal head 305*s* may be opened while the pressure control assembly 305*p* is closed and vice versa for removing and installing the downhole ESP components 100*d* riserlessly (akin to an airlock operation in a spaceship). The seal head 305*s* may include one ore more grease injector heads or stuffing boxes, such as two. The guide 305*g* may be a cone for receiving the downhole components 100*d* during re-deployment. The lubricator components may be connected, such as by flanged connections. Each of the lubricator components may include a tubular housing having a bore therethrough corresponding to a bore of the tree 50.

Each stuffing box may be operable to maintain a seal with the deployment cable 309 and the pump cable 135*r* while allowing the cables to slide in or out of the tool housing 305*h*. Each stuffing box may include an electric or hydraulic actuator in electric or hydraulic communication with the umbilical and a packer. The packer may be made from a polymer, such as an elastomer or a thermoplastic, such as rubber, polyurethane, or PTFE. The actuator may be operable between an engaged position and a disengaged position. In the engaged position, the actuator may compress the packer into sealing engagement with the cables 135*r*, 309 and in the disengaged position, the actuator may allow expansion of the packer to clear the bore for passage of the pump hanger 140 and the downhole components 100*d*. Each stuffing box may further include a biasing member, such as a spring, biasing the actuator toward the engaged position.

A running tool 320 may be connected to an end of the deployment cable 309. The running tool may 320 be operable to grip the crown plugs 56*u,l* and pump hanger 140 and release the crown plugs and pump hanger from the tree 50. The running tool 320 may further be operable to reset the crown plugs 56*u,l* and pump hanger 140 into the tree 50. The running tool 320 may include a body, a gripper, such as a collet, a locking sleeve (not shown), a releasing sleeve (not shown), and an electric actuator (not shown). The body may have a landing shoulder. The locking sleeve may be movable by the actuator between an unlocked position and a locked position. The locking sleeve may be clear of the collet in the unlocked position, thereby allowing the collet fingers to retract. The collet fingers may be biased toward an extended position. In the locked position, the locking sleeve may engage the collet fingers, thereby restraining retraction of the collet fingers. The releasing sleeve may be operable between an extended and retracted position. In the extended position, the releasing sleeve may hold the crown plugs/pump hanger down while the running tool body is raised from the crown plugs/pump hanger until the collet fingers disengage from the crown plug/pump hanger. The running tool 320 may further include a deployment latch to fasten the running tool to the lubricator 305 for deployment of the lubricator to the tree 50. The deployment latch may be released by the actuator once the lander 305*l* has been fastened to the tree 50.

To remove the upper crown plug 56*u*, the running tool 320 may be lowered to the upper crown plug with the locking sleeve and releasing sleeve in the retracted position. The collet fingers may engage the inner profile of the crown plug cam. The shoulder may then land on the crown plug body. The locking sleeve may then be extended. The deployment cable 309 may then be raised by the injector 312, thereby raising the cam sleeve until the cam sleeve engages with the crown plug body. Further raising of the crown plug body may force retraction of the dogs from the tree 50, thereby freeing the crown plug from the tree. The upper crown plug 56*u* may be raised into the tool housing 305*h*. The shutoff valve may then be closed. Additionally, the blind rams may also be closed to maintain a double barrier between the wellbore 5 and the sea 1. The seal head 305*s* may then be opened and the upper crown plug 56*u* retrieved to the vessel 301. The process may be repeated for removal of the lower crown plug 56*l*. Additionally, the crown plugs 56*u,l* may be washed (discussed below) while in the tool housing 305*h*.

Once the crown plugs 56*u,l* have been removed, the running tool 320 may then be lowered from the vessel 301 to the tree 50. The seal head 305*s* may be opened and the running tool 320 may enter the lubricator 305. The seal head 305*s* may then be closed against the deployment cable 309 and the shutoff valve may be opened. The running tool 320 may be lowered to the pump hanger 140 and the collet may engage the pump hanger profile. The running tool locking sleeve may be engaged and the running tool 320 and pump hanger 140 may be raised from the tubing hanger 53. The running tool 320 and pump hanger 140 may be raised into the tool housing 305*h*. The pressure control assembly stuffing boxes may then be closed against the pump cable 135*r*. A cleaning fluid may then be injected into the tool housing 305*h* via the umbilical 307. The cleaning fluid may include a gas hydrates inhibitor, such as methanol or propylene glycol. The spent cleaning fluid may be drained into the wellbore via a bypass conduit (not shown) in fluid communication with the tool housing bore and the lander bore and extending from the tool housing 305*h* to the lander 305*l*. The bypass conduit may include tubing. One or more check valves may be disposed in the bypass conduit operable to allow flow from the tool housing 305*h* to the lander 305*l* and preventing reverse flow. Alternatively, one or more shutoff valves having actuators in communication with the umbilical 307 may be disposed in the bypass conduit.

Once the pump hanger 140 has been cleaned, the seal head 305*s* may be opened and the injector 312 may raise the pump hanger 140 to the vessel 301 using the deployment cable 309. Once the pump hanger 140 exits the seal head 305*s* into the sea 1, the seal head may be closed against the pump cable 135*r*. The pressure control assembly stuffing boxes may then be opened or left close against the pump cable 135*r* for redundancy. The seal head and/or pressure control assembly stuffing boxes may maintain the pressure barrier between the wellbore 5 and the sea 1 as the pump hanger 140 is being retrieved to the vessel 301. Once the pump hanger 140 arrives at the vessel 301, the pump hanger may be removed from the pump cable 135*r* and the pump cable may be inserted into the injector 312 and wound onto a drum 318. The injector 312 may continue to retrieve the downhole components 100*d* by raising the pump cable 135*r*. Once the downhole components 100*d* reach the pressure control assembly 305*p*, the stuffing boxes may be opened (if not already so) and the downhole components 100*d* may enter the tool housing 305*h*. Once inside the tool housing 305*h*, the shutoff valve may be closed. Additionally, the shear rams may also be closed. The cleaning fluid may then be injected into the tool housing to wash the downhole components 100*d*. Once the downhole components 100*d* re washed, the seal head 305*s* may be opened and the downhole components may be retrieved to the vessel 301. The ESP 100 may be serviced or replaced and the repaired/replacement ESP may be installed using the lubricator 305 by reversing the process discussed above. Once the repaired/replacement ESP has been reinstalled, the crown plugs 56*u,l* may be reset, the lubricator 305 retrieved to the vessel 301 and the external cap 55 replaced. Production from the formation 25 may then resume.

Additionally, the lubricator 305 may include an injector 305*i*. The lubricator injector 305*i* may be operated after the pump hanger 140 is retrieved to the vessel 301. The lubricator injector 305*i* may allow the vessel 301 to be moved away from the wellbore 5 by a distance safe from a blow out if one should occur while removing the downhole components 100*d*. The injector 305*i* may be in communication with the umbilical 307 and be radially movable between an extended and retracted position. The injector 305*i* may be synchronized with the vessel injector 312 so that slack is maintained in the pump cable 135*r* as the downhole components 100*d* are being retrieved from the wellbore 5. The slack may also account for vessel heave. Alternatively, the injector 305*i* may be omitted.

The retrieval and replacement operation may be conducted while the formation 25 is alive. Alternatively, the formation 25 may be killed before retrieval of the ESP 100 by pumping a heavy weight kill fluid, such as seawater, into the production tubing 10*p*.

Figure 4A:
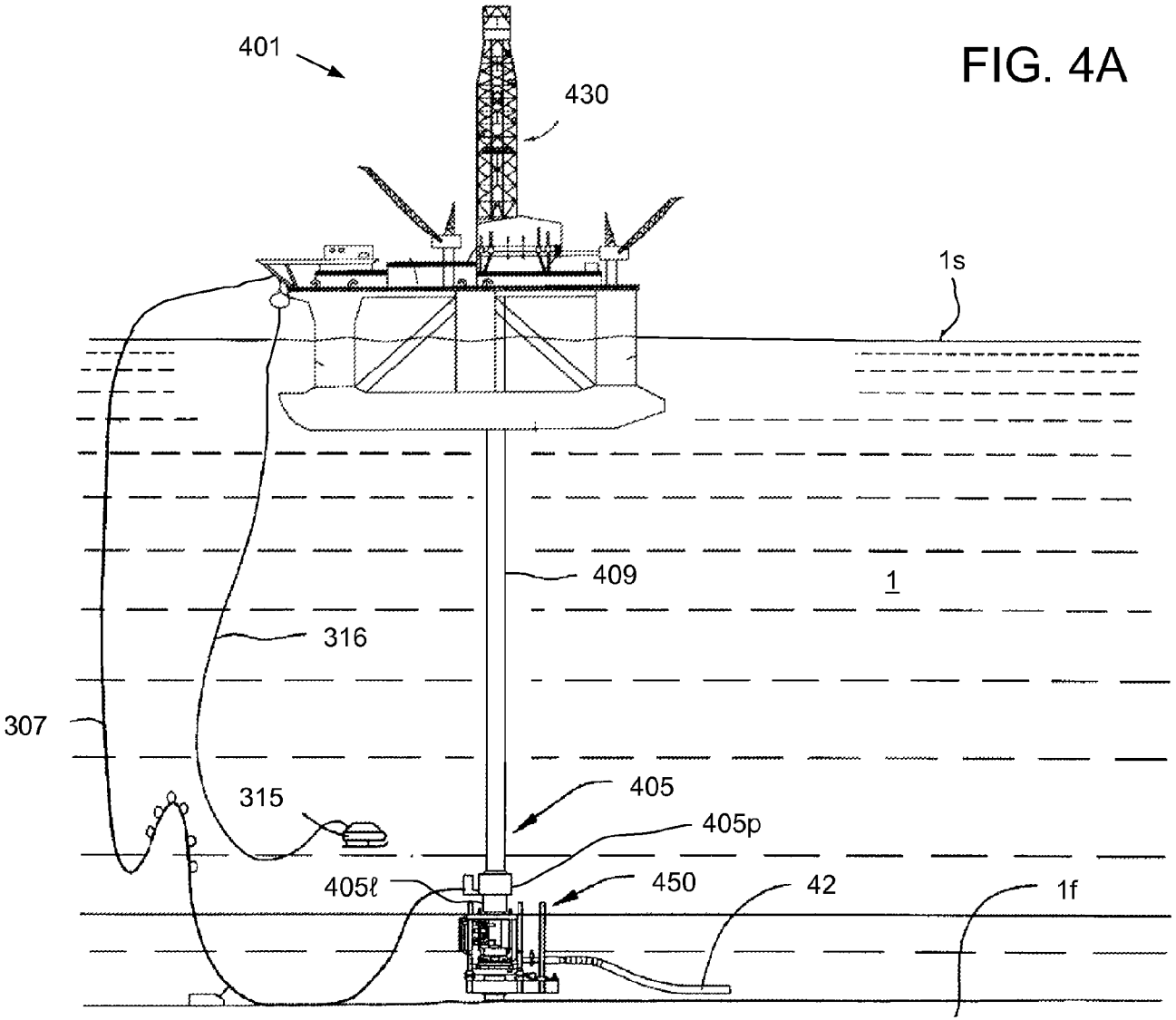
FIGS. 4A and 4B illustrate retrofitting an existing subsea tree for compatibility with the ESP, according to another embodiment of the present invention.
Figure 4B:
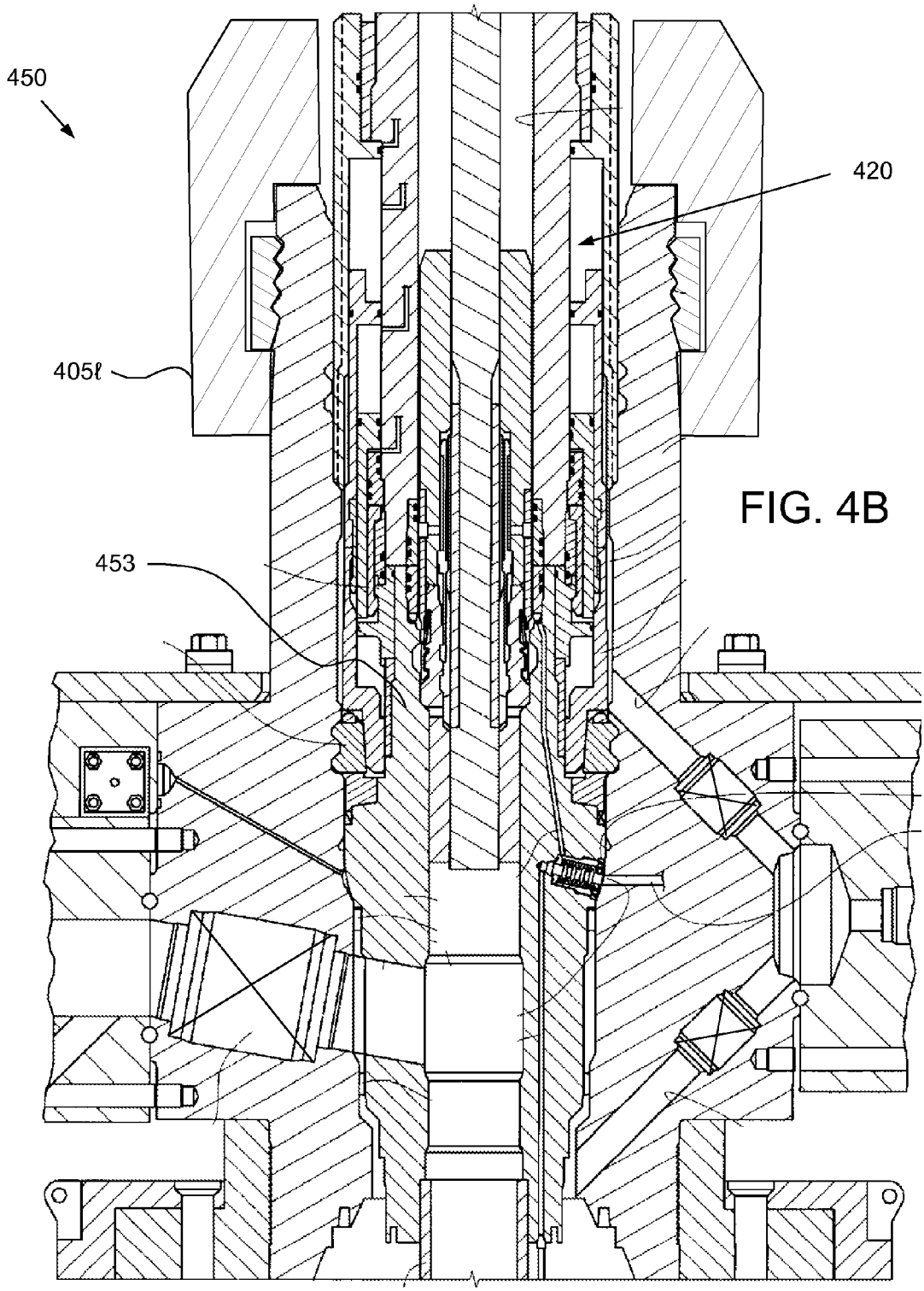

FIGS. 4A and 4B illustrate retrofitting an existing subsea tree 450 for compatibility with the ESP 100 according to another embodiment of the present invention. FIG. 4A illustrates deployment of a riser 409 to the tree 450. FIG. 4B illustrates retrieval of the existing tubing hanger 453 using a tubing hanger running tool (THRT) 420.

For initial installation of the ESP 100, the existing subsea tree 450 may require retrofitting to install the tubing hanger 53. A mobile offshore drilling unit (MODU), such as a semi-submersible 401 or drillship may be deployed to the tree 450. The MODU 401 may include a drilling rig 430 for deployment of a marine riser string 409 to the tree 450. A lower marine riser package (LMRP) 405 may be connected to the riser 409 for interfacing with the tree 450. The LMRP 405 may include pressure control assembly 405*p* and a lander 405*l*. Once the LMRP 405 has been landed onto the tree 450, the crown plugs 56*u,l* may be retrieved using the running tool 320. The THRT 420 may then be connected to a workstring (not shown), such as drill pipe. The THRT 420 and workstring may be lowered to the tree 450 through the riser 409. The THRT 420 may engage the internal tree cap 54 and release the cap 54 from the tree. The THRT 420 and tree cap may then be retrieved to the MODU 401. The THRT 420 may then again be deployed to the tree 450 through the riser 409. The THRT 420 may engage the existing tubing hanger 453 and release the tubing hanger from the tree 450. The THRT 420 and tubing hanger 453 may then be retrieved to the MODU 401 (the production tubing 10*p* may also be raised with the tubing hanger). Once retrieved to the MODU 401, the tubing hanger 453 may be replaced with the tubing hanger 53. The THRT 420 and the tubing hanger 53 may then be lowered to the tree 450. The tubing hanger 53 may be fastened to the tree 450. The ESP 100 may then be deployed through the riser 409 using the deployment cable 309 and running tool 320. The tree 450 may then be reassembled and the ESP 100 may be serviced riserlessly using the lubricator 50 and the light or medium duty vessel 301, as discussed above. The formation 25 may or may not be killed during the retrofitting operation.

Alternatively, for new installations, the tree 50 may be deployed and the formation 25 produced naturally and/or with other forms of artificial lift until the ESP 100 is required. Since the tree 50 already has the compatible tubing hanger 53, the ESP 100 may initially be deployed riserlessly (and with the formation 25 live) using the lubricator 50.

Alternatively, the ESP 100 may be deployed into a subsea wellbore having a vertical subsea tree, a land-based wellbore, or a subsea wellbore having a land-type completion.

While the foregoing is directed to embodiments of the present invention, other and further embodiments of the invention may be devised without departing from the basic scope thereof, and the scope thereof is determined by the claims that follow.

The invention claimed is:

1. A pumping system, comprising:
a submersible electric motor operable to rotate a drive shaft;
a pump rotationally connected to the drive shaft and comprising a rotor having one or more helicoidal vanes;
an isolation device operable to engage a production tubing string, thereby fluidly isolating an inlet of the pump from an outlet of the pump and rotationally connecting the motor and the pump to the production tubing string;
a cablehead operable to receive a lower end of a power cable; and
a submersible power conversion module (PCM) operable to:
receive a direct current power signal from the cablehead, and
supply a second power signal to the motor,
wherein:
the motor and the pump are operable at greater than or equal to ten thousand RPM,
the pump further comprises a stator having a housing and a diffuser,
a Venturi passage is formed between the rotor and the housing and between the housing and the diffuser,
the diffuser has one or more vanes located at a throat of the Venturi passage, and
the diffuser vanes are operable to negate swirl imparted by the helicoidal vanes.

2. The pumping system of claim 1, further comprising the power cable having two or less conductors and a strength sufficient to support the motor, the pump, the isolation device, and the PCM.

3. The pumping system of claim 2, further comprising a pump hanger:
receiving an upper end of the power cable, and
having electrical contacts disposed along an outer surface thereof for engagement with a production tubing hanger.

4. The pumping system of claim 2, further comprising a lubricator comprising a tool housing operable to contain the pump, motor, isolation device, and PCM.

5. The pumping system of claim 4, wherein:
the lubricator further comprises first and second seals,
each seal is operable between an extended position and a retracted position, and
each seal clears a bore in the retracted position and seals against the cable in the extended position.

6. The pumping system of claim 5, wherein the lubricator further comprises:
a lander operable to fasten to a profile of a production tree, and
a bypass conduit extending between the tool housing and the lander.

7. The pumping system of claim 1, wherein:
the motor is a switched reluctance or brushless DC motor, and
the PCM is operable to supply the second signal by sequentially switching phases of the motor.

8. The pumping system of claim 1, further comprising a seal section having a shaft seal operable to seal the drive shaft from the rotor.

9. A pumping system, comprising:
a submersible electric motor operable to rotate a drive shaft; and
a submersible pump having one or more stages, each stage comprising:
a tubular housing;
a mandrel disposed in the housing and comprising:
a rotor rotationally connected to the drive shaft and rotatable relative to the housing and having:
an impeller portion,
a shaft portion, and
one or more helicoidal vanes extending along the impeller portion, and
a diffuser:
connected to the housing,
having the shaft portion extending therethrough, and
having one or more vanes located at a throat of a Venturi passage and operable to negate swirl imparted to fluid pumped through the impeller portion; and
the Venturi passage formed between the mandrel and the housing,
wherein the motor and the pump are operable at greater than or equal to ten thousand RPM.

10. The pumping system of claim 9, further comprising:
a cablehead operable to receive a lower end of a power cable; and
a submersible power conversion module (PCM) operable to:
receive a direct current power signal from the cablehead, and
supply a second power signal to the motor.

11. The pumping system of claim 10, further comprising the power cable having two or less conductors and a strength sufficient to support the motor, the pump, and the PCM.

12. The pumping system of claim 10, wherein:
the motor is a switched reluctance or brushless DC motor, and
the PCM is operable to supply the second signal by sequentially switching phases of the motor.

13. The pumping system of claim 9, further comprising a seal section having a shaft seal operable to seal the drive shaft from the rotor.

14. A pumping system, comprising:
a submersible electric motor operable to rotate a drive shaft;
a pump rotationally connected to the drive shaft and comprising a rotor having one or more helicoidal vanes;
an isolation device operable to engage a production tubing string, thereby fluidly isolating an inlet of the pump from an outlet of the pump and rotationally connecting the motor and the pump to the production tubing string;

a cablehead operable to receive a lower end of a power cable; and a submersible power conversion module (PCM) operable to:

receive a direct current power signal from the cablehead, and supply a second power signal to the motor;

the power cable having two or less conductors and a strength sufficient to support the motor, the pump, the isolation device, and the PCM;

a lubricator comprising a tool housing operable to contain the pump, motor, isolation device, and PCM;

wherein:

the motor and the pump are operable at greater than or equal to ten thousand RPM, the lubricator further comprises first and second seals, each seal is operable between an extended position and a retracted position, and each seal clears a bore in the retracted position and seals against the cable in the extended position, and the lubricator further comprises:

a lander operable to fasten to a profile of a production tree, and a bypass conduit extending between the tool housing and the lander.

* * * * *